US006520269B2

(12) United States Patent
Geiger et al.

(10) Patent No.: US 6,520,269 B2
(45) Date of Patent: Feb. 18, 2003

(54) HAND-HELD TOOL WITH ELECTROMAGNETIC HAMMER MECHANISM

(75) Inventors: Harald Geiger, Pürgen (DE); Hubert Daxenberger, Herrsching (DE); Ronald Vuillemin, Niederlinsbach (CH); Marcel Jufer, Lausanne (CH); Udo Schochtert, Muzzano (CH)

(73) Assignee: Hilti Aktiengesellschaft, Schaan (LI)

( * ) Notice: Subject to any disclaimer, the term of this patent is extended or adjusted under 35 U.S.C. 154(b) by 60 days.

(21) Appl. No.: 09/855,072

(22) Filed: May 14, 2001

(65) Prior Publication Data

US 2002/0014344 A1 Feb. 7, 2002

(30) Foreign Application Priority Data

May 23, 2000 (DE) ..... 100 25 371

(51) Int. Cl.[7] ..... B25D 13/00
(52) U.S. Cl. ..... 173/117; 173/114; 173/217
(58) Field of Search ..... 173/117, 217, 173/114, 171, 13; 227/131, 113

(56) References Cited

U.S. PATENT DOCUMENTS

| | | | | |
|---|---|---|---|---|
| 3,054,464 A | * | 9/1962 | Ondeck | 173/117 |
| 3,308,892 A | * | 3/1967 | Palmer | 173/117 |
| 3,811,313 A | * | 5/1974 | Schut | 173/117 |
| 4,237,987 A | * | 12/1980 | Sherman | 173/117 |
| 5,497,555 A | * | 3/1996 | Averbukh | 173/117 |
| 5,666,715 A | * | 9/1997 | Zoiss et al. | 227/131 |

* cited by examiner

*Primary Examiner*—Scott A. Smith
(74) *Attorney, Agent, or Firm*—Sidley Austin Brown & Wood, LLP

(57) ABSTRACT

A hand-held tool including an electromagnetic hammer mechanism (1) for applying a percussion movement to a working tool (3) and including at least one stator, at least one coil (4*a*), a striking piston formed as a yoke (10) supported in a magnetic flux for a limited displacement along the oscillation axis (A) and having at least one magnetomotive region (11) formed of a soft magnetic ferroelectric material, and at least one magnet (5*a*) associated with the stator, magnetizable along the oscillation axis (A), and arranged along and adjacent to at least one segment of the coil (4*a*) located at an end of the stator.

12 Claims, 3 Drawing Sheets

HAND-HELD TOOL WITH ELECTROMAGNETIC HAMMER MECHANISM

BACKGROUND OF THE INVENTION

1. Field of the Invention

The present invention relates to a percussion hand-held tool, e.g., a chisel hammer or a hammer drill, with an electromagnetic hammer mechanism.

2. Description of the Prior Art

In hand-held tools with an electromagnetic hammer mechanism, a striking piston, which imparts axial blows to a working tool primarily via an intermediate piston, reciprocates under an action of timewise changeable magnetic field.

U.S. Pat. No. 4,215,297 discloses a hand-held tool in which a striking piston, which is supported for a limited axial movement relative to the working tool, cooperates with a ferromagnetic insert coaxially arranged inside of a coil that produces an intermittently changeable magnetic field. The striking piston is connected with a storage spring for storing the recoil energy. The drawback of such an arrangement consists in a poor electrical efficiency of the percussion or impact energy that can be achieved. The increase of the electrical efficiency is only possible with an unacceptable decrease of the service life of the hand-held tool.

German Publication DE 198 39 464A1 discloses a hand-held tool in which an electrodynamic actuator is arranged in a magnetic flux circuit which passes through a permanent magnet, a coil, and an anchor formed of a soft ferromagnetic material. The yoke, here the anchor and the coil, is supported for a limited movement transverse to the magnetic flux, which passes through adjoining surface regions of the U-shaped stator, by springs provided on opposite sides of the yoke. An alternate current passing through the coil can produce constrained oscillations of the obtained spring-mass system. The drawback of this solution consists in that in order to be able to use the above-described striking system as a hammer mechanism for a hand-held tool, piston-forming components should have large masses. Another drawback of this solution is a need to provide additional elements for feeding current to the movable coil, which reduce the service life of the hammer mechanism.

In the hand-held tool disclosed in WO 9940673 A1, an oscillating linear drive functions in accordance with a principle of a polarized reluctant actuator (PRA). In the disclosed hammer mechanism, a yoke, here an anchor and a magnet, are displaceably supported in a magnetic flux circuit, with the magnetic flux passing through the permanent magnet, the coil, and the anchor which is formed of a soft ferromagnetic material. The yoke is displaced by a flux passing transverse to the magnetomotive regions of the yoke and having a variable flux density which is varied between both pole shoes by the control magnetic field of a coil of a U-shaped stator, or is displaced by electric field gradients provided in the magnetomotive region in the direction of a minimal total forward resistance. The drawback of the proposed solution consists in that the magnetic and mechanical characteristics of permanent magnets, which are to be used in hammer mechanisms of hand-held tools, are very sensitive to impacts.

An object of the present invention is to provide a hand-held tool with an eletromagnetic hammer mechanism having an increased impact or percussion energy efficiency without any reduction of the service like in comparison with conventional electromagnetic hammer mechanisms.

SUMMARY OF THE INVENTION

This and other objects of the present invention, which will become apparent hereinafter, are achieved by providing an electromagnetic hammer mechanism including at least one stator, at least one coil with an axis extending transverse to the oscillation axis of the working tool, a striking piston formed as a yoke supported in a magnetic flux for a limited displacement along the oscillation axis and having at least one magnetomotive region formed of a soft magnetic ferroelectric material, and at least one magnet associated with the stator, magnetizable along the oscillation axis, and arranged along and adjacent to at least one segment of the coil located at an end of the stator.

According to the present invention, as a hammer mechanism, an oscillating linear motor, which is based on a principle of a polarized reluctance actuator (PRA) is used. A magnetic flux-generating magnet is magnetized in the percussion direction of the working tool which corresponds to the direction in which the working tool oscillating axis extends. The magnet is arranged along and adjacent to a coil segment located at an end of the U-shaped stator.

According to the present invention, a pole shoe, which is associated with the segment located at the U-shape stator end, is divided by a gap transverse to the working tool oscillation axis and the coil axis in two half-pole shoes, with the magnetic flux being divided between the two half-pole shoes by a control magnetic field of the energized coil. The yoke, which bridges both pole shoes of the stator and is supported for a limited movement along the working tool oscillation axis, has a magnetomotive region associated with the pole shoes. This region, at least along the working tool oscillation axis, consists of a soft magnetic ferroelectic material. The joke has, with respect to the two half-pole shoes, respective positions along the working tool oscillation axis in which the resulting total magnetic resistance in the gross flux circuit is at a minimum.

In this way, by changing the direction of the current flow through the coil, a bipolar behavior with respect to the anchor position can be realized or, the forces, which can be used for producing oscillations, can be applied to the yoke, which forms an anchor of a linear motor and which is located between the two positions, in both directions. The linear motor anchor functions as a striking piston and because the striking piston-forming anchor can have a small mass, only light vibrations of the hand-held tool are generated.

Advantageously, the strength of the coil current is selected in accordance with the condition of the increase of the flux, which is generated by the magnet, in a half-pole shoe. This permits to double the flux in another half-pole shoe. In this way, the coil provides for an optimal controlled behavior of the anchor.

Advantageously, the anchor has its end surface, remote from the working tool, connected to the hand-held tool housing by a storage spring for storing the recoil energy. The resulting energy-storing, self-oscillating system further increases the efficiency of the inventive hammer mechanism.

In accordance with a further advantageous embodiment of the present invention, a pole-shoe, which is divided by a gap into two half-pole shoes, is associated with each of two opposite segments of the coil provided at respective ends of the stator having a U-shape cross-section in the longitudinal direction. The anchor is formed with two magnetomotive regions associated with respective pairs of half-pole shoes and extending in the direction of the half-pole shoes. The anchor is so formed that it has a minimal magnetic resistance in the magnetomotive regions. As a result, the forces, which are generated due to the energization of the coil and by apportioning of the flux, are added to each other. With mirror-symmetrical arrangement of the system in a plane perpendicular to the working tool oscillation axis, the forces are doubled.

Advantageously, a spacer, which is provided between the two magnetomotive regions of the anchor, can be formed with a small mass, while maintaining an adequate stability. This permits to reduce the mass of the striking piston, by preferably symmetrical narrowing of the anchor, i.e., of the yoke anchor cross-section. However, care should be taken to maintain a minimal necessary flux cross-section.

In accordance with a further advantageous embodiment of the present invention, a further stator, which has a longitudinal U-shaped cross-section and which is arranged rotationally symmetrically with the first stator with respect to the working tool oscillation axis, is associated with the common, anchor. The further or second stator is associated with further magnetized magnet, half-pole shoes, and segments of another energized coil. The provision of the second stator system increases the forces acting on the anchor. When the second system is arranged symmetrically with respect to the first system, these forces are again doubled.

Advantageously, with respect to both longitudinally U-shaped stators, the current flows through both coils in the same direction, but the two magnets, which are associated with respective coils are magnetized in opposite directions. As a result, with the symmetrical arrangement of the four half-pole shoes pairs, the flux in the anchor between the two magnetomotive regions arranged along the oscillation axis, increases. Therefore, no measures are needed to maintain a minimal flux cross-section of the magnetomotive regions, and a less thick spacer between the two magnetomotive regions can be used as its magnetic characteristics can be disregarded.

While capable to withstand high mechanical alternating loads, the, advantageously, one-piece anchor, which forms the striking piston, can be formed with a relatively small mass, forming a composite striking piston with a spacer formed of a light material.

The magnetic flux circuit is closed through both U-shaped stators and both, axially spaced along the oscillation axis, magnetomotive regions of the anchor. The flux passes through the magnetomotive regions in a direction transverse to the oscillation axis, which permits to maximize the force acting on the anchor.

Advantageously both coils are partially curved about the oscillation axis, which permits to reduce the space requirement, while retaining the same power.

Advantageously, the striking piston-forming anchor is formed with flat surfaces in the direction the flux passes therethrough. The anchor is formed as a mirror-symmetrical part, with rising, relative to the cross-section, surfaces of the magnetomotive regions. The transversely extending side edges serve advantageously for positioning of the striking pistion-forming anchor transverse to the oscillation axis, and as guide means parallel to the oscillation axis.

With the advantageously rhombic cross-section of the flat striking piston-forming anchor or yoke, the portions of the magnetomotive regions, which form an acute angle and which define the side edges, serve far positioning or guiding the corresponding, associated angularly-shaped pole shoes in the U-shaped stators. To prevent friction and the resulting wear, thin, slidable, preferably magnetic gap-forming, non-magnetic shims are placed on the pole shoes and/or the respective portions of the magnetomotive surfaces.

Advantageously, an end surface of the striking piston-forming anchor or yoke adjacent to the working tool, is provided with a radial circular surface which is so formed that it transmits blows to the working tool or an intermediate piston with a minimum wear.

Advantageously, the end surface, adjacent to the storage spring, of the striking-piston forming anchor or yoke is provided with at least partially radial annular surface for forming at least partial circumferential contact with the storage spring. Advantageously, in order to reduce weight, a blind bore is formed within this surface.

Advantageously, a preload spring applies a biasing force to the end surface of the striking piston-forming anchor or yoke adjacent to the working tool. As a result, a steady operation of both springs in the region of alternating loads and in the region of oscillating loads in insured. This increases the service life of both spring.

The novel features of the present invention which are considered as characteristic for the invention, are set forth in the appended claims. The invention itself, however, both as to its construction and its mode of operation, together with additional advantages and objects thereof, will be best understood from the following detailed description of preferred embodiments when read with reference to the accompanying drawings.

DETAILED DESCRIPTION OF THE PREFERRED EMBODIMENT

Figure 1:
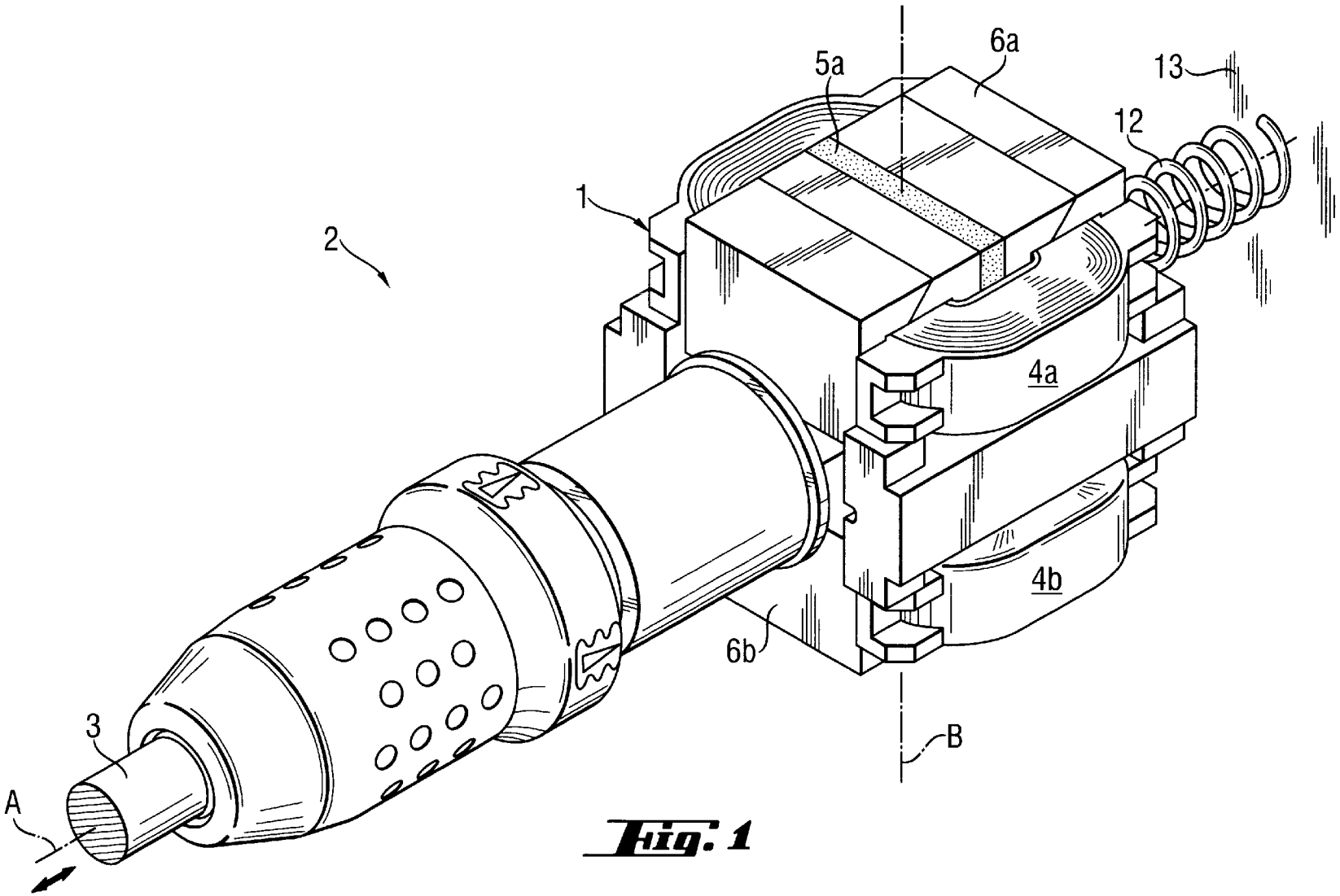
FIG. 1 a perspective view of an electromagnetic hammer mechanism according to the present invention for a hand-held tool.

An electromagnetic hammer mechanism 1 according to the present invention, which is shown in FIG. 1, is located inside of a hand-held tool 2 that has a working tool 3. The hammer mechanism 1 is arranged along an oscillation axis A of the working tool. An axis B of coils 4*a* and 4*b* of the hammer mechanism 1 extends transverse to the axis A. The stator of the hammer mechanism includes permanent magnets 5*a*, 5*b* which are oriented along the oscillation axis A and which are associated with segments of respective coils 4*a*, 4*b*.

Figure 2:
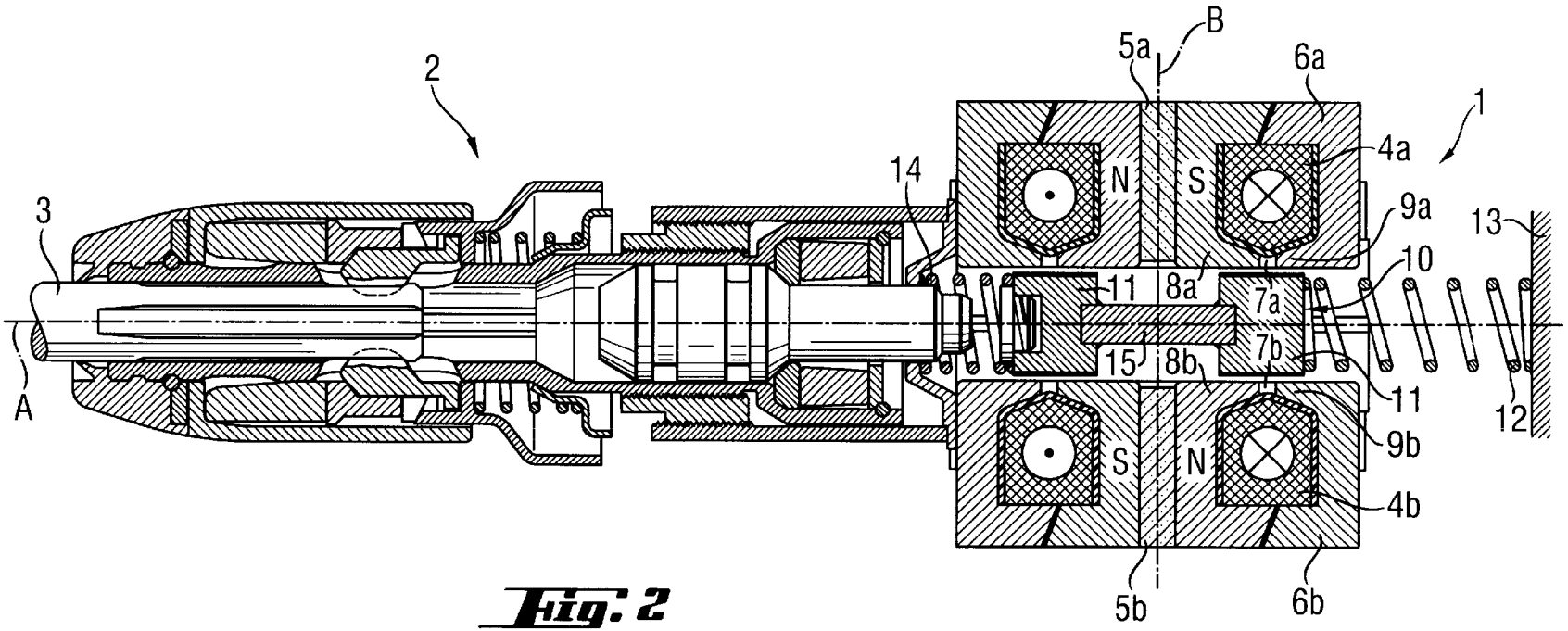
FIG. 2 a cross-sectional view of the hammer mechanism shown in FIG. 1.

FIG. 2 shows a cross-sectional view of the inventive hammer mechanism 1 along a plane containing the oscillation axis A and the axis B. The magnets 5*a* and 5*b* which, advantageously, are formed as permanent magnets and which produce a magnetic flux, are oppositely magnetized in a direction which coincides with the longitudinal extent of the oscillation axis A corresponding to the percussion direction, the direction the impacts are applied to the working tool 3. The magnets 5*a*, 5*b* are arranged along respective segments of respective coils 4*a*, 4*b*. The segments of the respective coils 4*a*, 4*b* are located between respective ring cores 6*a*, 6*b*, which partially surround, respectively, opposite segments of the respective coils 4*a*, 4*b*, and respective U-shaped stators associated with the magnets 5*a*, 5*b* and arranged between the magnets 5*a*, 5*b* and the respective segments of the coils 4*a*, 4*b*.

A pole shoe, which is located at an end of a respective stator and is associated with respective segments of the coils 4*a*, 4*b*, is divided by a gap 7*a*, 7*b*, transverse to the oscillation axis A and parallel to the axis B in two half-pole shoes 8*a*, 8*b*, 8*b*, 9*b*, respectively. By controlling the magnetic field of the energized segments of the respective coils 4*a*, 4*b*, the magnetic flux can be divided between the half-pole shoes 8*a*, 9*a* and 8*b*, 9*b*.

A yoke 10 bridges both pole shoes of each stator and is supported for a limited displacement along the oscillation axis A. At least the magnetomotive regions 11 of the yoke 10, which are associated with the pole shoes consist, along the oscillation axis A, of a soft magnetic ferroelectrical material. The yoke 10 is capable of occupying bistable switchable positions along the oscillation axis A which are characterized by a maximum planar abutment between the magnetomotive regions 11 and the half-pole shoes 8*a* and 9*a* and 8*b* and 9*b*, respectively. The switching of the positions is influenced by the flow of current through the coil 4*a*, 4*b* in opposite directions. The yoke 10 forms an anchor of an oscillating linear motor which, in turn, forms the striking piston. The yoke 10 is connected, at its end remote from the working tool 3, via a storage spring 12 for storing the recoil energy, with the housing 13 of the hand-held tool 2, and is connected, at its end adjacent to the working tool 3, with a preloaded spring 14.

Each of two opposite segments of the coil 4*a* (or 4*b*) is associated, as discussed above, with the pole shoe provided at the respective end of the U-shaped stator. As further discussed above, each pole shoe is divided by a gap 7*a*, 7*b* into two half-pole shoes 8*a*, 9*a* or 8*b*, 9*b*. The yoke 10 has its magnetomotive regions 11 so formed that they flatly abut respective half-pole shoes 8*a* and 9*a* (8*b* and 9*b*).

A spacer 15, which is provided between the magnetomotive regions 11 of the anchor-forming yoke 10 is formed of a non-ferromagnetic material, e.g. aluminum or plastics. The two U-shaped stators, which include the respective ring cores 6*a*, 6*b* partially surrounding respective segments of the energized, in the same directions, coils 4*a*, 4*b*, are arranged rotationally symmetrically with respect tot he oscillation axis A.

Figure 3:
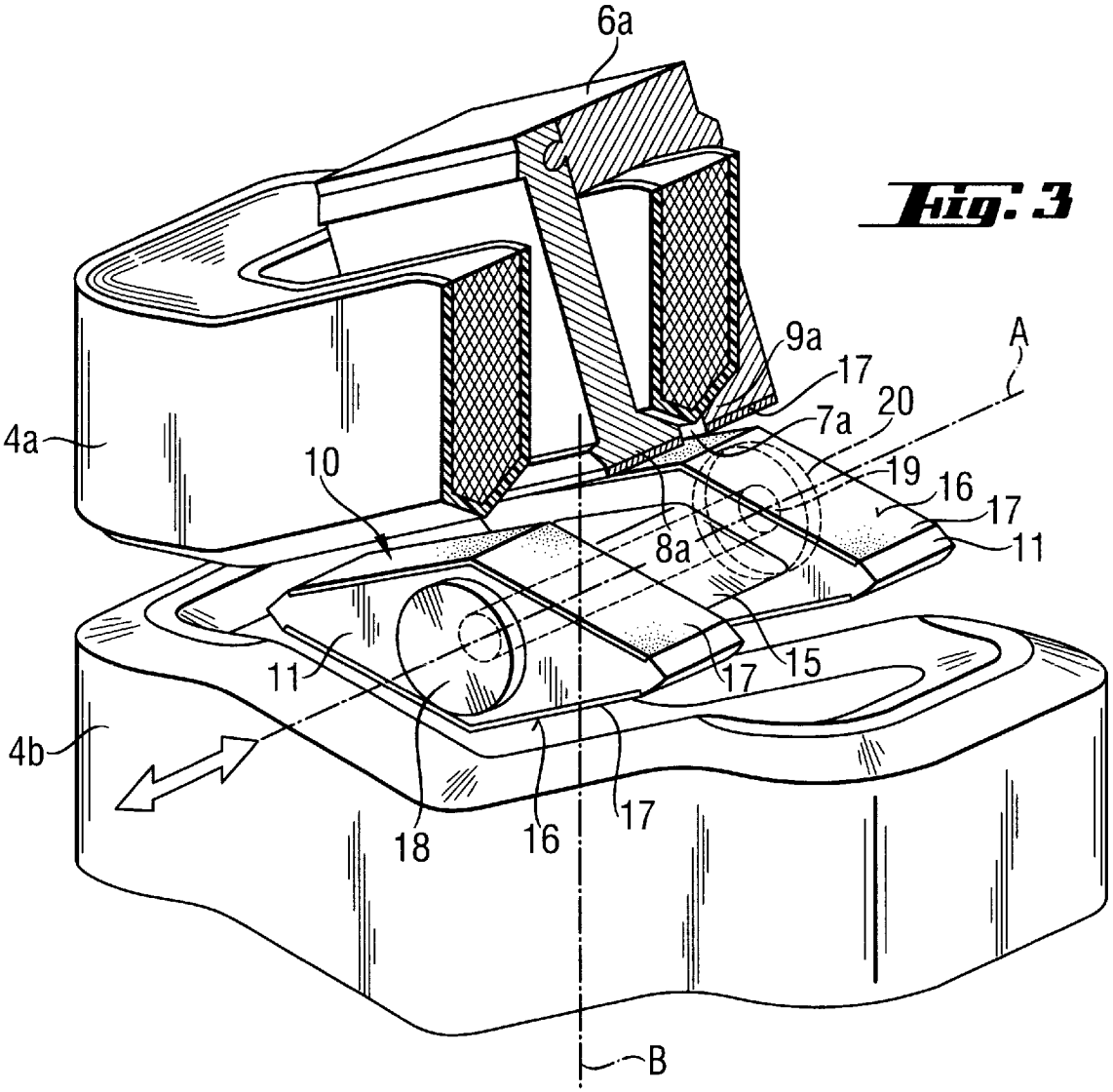
FIG. 3 a perspective, partially cross-sectional view of components of a hammer mechanism according to the present invention with a stricking piston.

In the embodiment shown in FIG. 3, the two coils 4*a*, 4*b* are partially turned about the oscillation axis A. In FIG. 3, only the ring core 6*a*, which surrounds a segment of the coil 4*a*, is shown. The yoke 10, which forms the anchor that serves as a striking piston, has a flat mirror symmetry with respect to the axis B and the passing through it flux. The side edges 16 advantageously serve for positioning the striking piston-forming yoke transverse to the oscillation axis and as a guide extending parallel to the oscillation axis A. The rhomb-shaped side edges 16 are associated with (shown only schematically) an angle-forming pole shoe formed of two half-pole shoes 8*a*, 9*a* separated by a gap 7*a*. A thin slidable spacer 17, which is formed of a non-ferromagnetic material and is arranged between respective edges 16 and which forms a magnetic gap, covers parts of energized surfaces. An end surface of the striking piston-forming yoke, adjacent to the working tool, includes a radial circular surface 18 which is designed for transmission of impacts to the working tool or to an intermediate piston with minimum wear. The end surface of the striking piston-forming yoke, which is adjacent to the storage spring, includes at least partially radial circular surface 20 which surrounds blind bore 19 and forms at least a partial circumferential contact with the storage spring.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A hand-held tool, comprising a working tool (3); and an electromagnetic hammer mechanism (1) for applying a percussion movement to the working tool (3) along an oscillation axis (A), the electromagnetic hammer mechanism (1) including at least one stator, at least one coil (4*a*) having an axis (B) extending transverse to the oscillation axis (A), a striking piston formed as a yoke (10), supported in a magnetic flux for a limited displacement along the working tool oscillation axis (A), and having at least one magnetomotive region (11) formed of a soft magnetic ferroelectric material, and at least one magnet (5*a*) associated with the stator, magnetizable along the oscillation axis (A) and arranged along and adjacent to at least one segment of the coil (4*a*) located at an end of the stator.

2. A hand-held tool according to claim 1, wherein the electromagnetic hammer mechanism (1) further comprises a pole shoe associated with the segment of the coil (4*a*) located at the stator end and separated by a gap (7*a*) transverse to the working tool oscillation axis (A) and along the axis (B) in two half-pole shoes (8*a*, 9*a*).

3. A hand-held tool according to claim 2, wherein the electromagnetic hammer mechanism (1) further includes another stator arranged rotationally symmetrically, with respect to the working tool oscillation axis (A), relative to the at least one stator, another coil (4*b*), another magnetizable magnet (5*b*) associated with the another stator, another pole shoe separated by a gap (7*b*) transverse to the oscillation axis (A) and the axis (B) in two half-pole shoes (8*b*, 9*b*), and wherein the yoke (10) has tow magnetomotive regions (11) associated with respective half-pole shoes (8*a*, 9*a*; 8*b*, 9*b*).

4. A hand-held tool according to claim 3, wherein with respect to both stators, the magnets (5*a*, 5*b*) are magnetized in opposite directions, and current flows through the coils (4*a*, 4*b*) in a same direction.

5. A hand-held tool according to claim 4, wherein a magnetic flux flows through the magnetomotive regions of the yoke (10) transverse to the tool oscillation axis (A).

6. A hand-held tool according to claim 3, wherein both coils (4*a*, 4*b*) are partially curved about the oscillation axis (A).

7. A hand-held tool according to claim 3, wherein the pole shoes are arranged at an angle and are associated with respective portions of the magnetomotive surfaces of the yoke that has a rhombic shape.

8. A hand-held tool according to claim 7, wherein a thin, slidable, non-ferromagnetic spacer is provided between at least one of the pole shoes and the portions of the magnetomotive surfaces of the striking piston-forming yoke.

9. A hand-held tool according to claim 1, wherein the coil (4*a*) has another segment located opposite the at least one segment, wherein the electromagnetic mechanism (1) further comprises a pole shoe provided at a respective end of the stator, associated with a respective one of the at least one segment and another segment of the coil (4*a*), and separated by a gap (7*a*) transverse to the oscillation axis (A) and the axis (B) into two half-pole shoes (8*a*, 9*a*), and wherein the yoke (10) has two magnetizable regions (11) associated with a respective segments of the coil (4*a*) and extending in a direction of the half-pole shoes (8*a*, 9*a*), and formed with a minimal magnetic resistance.

10. A hand-held tool according to claim 1, wherein the striking piston-forming yoke (10) has a mirrored symmetry and has flat surfaces along which magnetic flux propagates and which are provided with side edges (16).

11. A hand-held tool according to claim 1, further comprising a recoil energy-storing storage spring (12) connecting an end surface of the yoke (10) remote from the working tool (3) with a hand-held tool housing (13).

12. A hand-held tool according to claim 11, further comprising a preloaded spring (14) for applying as biasing force to an end surface of the striking piston-forming yoke (10) adjacent to the working tool (3), the preloaded spring (14) is being preloaded by the storage spring (12).

* * * * *